United States Patent [19]

Kaucic

[11] Patent Number: 4,657,060

[45] Date of Patent: Apr. 14, 1987

[54] VERTICAL VENETIAN BLIND WITH INLINE DRIVE

[75] Inventor: Edward M. Kaucic, Middleton, Wis.

[73] Assignee: Graber Industries, Inc., Middleton, Wis.

[21] Appl. No.: 353,333

[22] Filed: Mar. 1, 1982

[51] Int. Cl.[4] ..... E06B 9/36

[52] U.S. Cl. ..... 160/168 R; 160/176 R; 160/166 A

[58] Field of Search ..... 160/168, 172, 176; 74/785, 788, 801

[56] References Cited

U.S. PATENT DOCUMENTS

| | | | |
|---|---|---|---|
| 1,211,023 | 1/1917 | Willis | 74/801 |
| 2,848,045 | 8/1958 | Bennett . | |
| 2,993,535 | 7/1961 | Taylor . | |
| 3,115,791 | 12/1963 | Dean | 24/785 |
| 3,280,891 | 10/1966 | Eldredge, Jr. et al. . | |
| 3,752,208 | 8/1973 | Roberts | 74/785 |
| 3,878,877 | 4/1975 | Bruneau et al. | 160/168 |
| 4,122,884 | 10/1978 | Salzmann . | |

*Primary Examiner*—Ramon S. Britts
*Assistant Examiner*—David M. Purol
*Attorney, Agent, or Firm*—Vernon J. Pillote

[57] ABSTRACT

A vertical venetian blind of the type in which carriages having rotatable slat carriers are mounted for movement along a horizontal support channel and in which the slat carriers on the several carriages are simultaneously rotated by means of a shaft extending longitudinally of the channel. The shaft drive mechanism includes a planetary type gear mechanism mounted in the channel in-line with the operating shaft to drivingly interconnect a drive sprocket at the end of the housing to the shaft with a relatively high speed reduction.

11 Claims, 7 Drawing Figures

VERTICAL VENETIAN BLIND WITH INLINE DRIVE

BACKGROUND OF THE INVENTION

In vertical venetian blinds, the slats are commonly supported on carriages for movement along a trackway to enable opening and closing of the blind and the slats are also supported on the carriages for rotation above the lengthwise axis of the slat to control the light that passes through the blind. Rotation of the slat carriers in unison is effected by an operating shaft that extends lengthwise of the trackway and which is connected through gearing in each of the carriages to the slat carrier to rotate the slat. In some such vertical venetian blinds, for example as shown in U.S. Pat. Nos. 2,848,045 and 2,993,535, a drive sprocket is connected directly to one end of the operating shaft to rotate the shaft in response to a pull exerted on one or the other of the runs of a flexible chain entrained over the drive sprocket. However, in order to enable more precise control of the angle of the slats, it is desirable in some applications to provide a speed reduction drive for the operating shaft. U.S. Pat. No. 3,280,891 discloses a vertical venetian blind traverse apparatus having an eccentric cam and gear type speed reducer for connecting a drive sprocket to the shaft with a speed reduction. The eccentric cam and gear type speed reducer of this patent, however, produced a non-uniformed rotation of the shaft in response to rotation of the drive sprocket. In addition, it utilized a relatively large number of parts which made it somewhat expensive to fabricate and assemble. Further, in this patent the guide pulleys for the carriage traverse cords were spaced inwardly of the end of the rod to provide clearance for the speed reducer mechanism and therefore required substantial space between the end slat and the window opening in order to provide clearance for manipulating the downwardly extending runs of the carriage reverse cords.

It has also been proposed as shown in U.S. Pat. No. 4,122,884 to provide a worm and gear type speed reducer in which the input shaft extended through the front wall of the trackway at right angles to the operating shaft. This reduces the dead space required at the end of the head rail for the operating mechanism of the venetian blind. However, it is desirable in some installations to provide an operating mechanism which does not extend from the front of the head rail.

SUMMARY OF THE INVENTION

It is the general object of the present invention to overcome the disadvantages of the prior art by providing a vertical venetian blind apparatus having an improved speed reducing drive mechanism disposed in-line with the blind operating shaft at the end of the carriage support channel and which produces a relatively high speed reduction between the drive sprocket and the blind operating shaft for accurately controlling the slat position, and which minimizes the dead space required between the end slat and the window opening for operating the blind.

Another object of this invention is to provide a vertical venetian blind apparatus having an improved speed reducing drive mechanism in accordance with the foregoing object, and in which the drive mechanism can be economically fabricated and assembled.

Accordingly, the present invention provides, in a vertical venetian blind closure of the type including a horizontal carriage guide channel having an opening along one side, a shaft extending lengthwise of the channel, a plurality of carriages mounted on the guide channel for movement therealong, a slat carrier mounted on each of the carriages for rotation about an upright axis, gear means in each of the carriages engageable with the shaft and with respective slat carriers for rotating the latter in response to rotation of the shaft, and a shaft turning mechanism at one end of the shaft for turning the same, the improvement comprising the shaft turning mechanism including a stationary housing disposed substantially entirely within the channel at one end thereof and having an annular internal ring gear coaxial with the shaft, a planet carrier rotatably supported on the housing for rotation about the axis of the ring gear and having an axial hub non-rotatably connected to the shaft, a drive wheel rotatably supported on the housing for rotation about the axis of the ring gear and having a sun gear at one side extending into the ring gear concentrically of the latter and a drive sprocket at the other side, at least one planet gear in meshing engagement with the sun and ring gears and mounted on the planet carrier for rotation about an axis parallel to the axis of the ring gear and spaced radially inwardly therefrom to rotate the planet carrier in response to rotation of the drive wheel but at a relatively reduced speed, and a flexible drive chain entrained over the sprocket for rotating the drive wheel.

These, together with other objects, features and advantages of this invention will be more readily understood by reference to the following detailed description when taken in connection with the accompanying drawings wherein.

Figure 7:
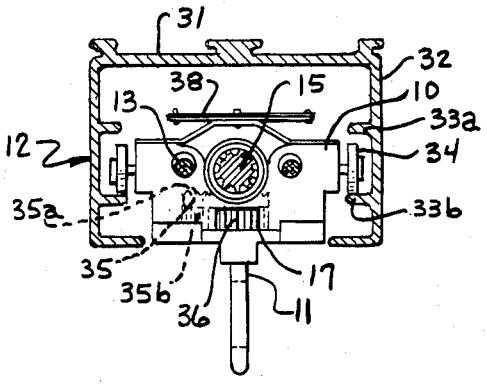
FIG. 7 is a transverse vertical sectional view taken on the plane 7—7 of FIG. 1.

The present invention relates to a vertical venetian blind construction of the type in which carriages 10 having rotatable slat carriers 11 are mounted for movement along a horizontal support channel 12 by means of traverse cords 13 extending lengthwise of the channel, and in which the slat carriers on the several carriages are simultaneously rotated by means of a spline shaft 15 extending longitudinally of the channel and gear mechanism 17 (FIG. 7) on each of the carriages that mesh with the spline shaft. The invention is particularly directed to an improved speed reducing drive mechanism 21 adapted to be mounted inside the end of the channel and in-line with the blind operating shaft 15 for driving the latter.

The support channel 12 is adapted to be mounted at one side of a window opening and includes a top wall 31 and depending side walls 32. Any suitable means may be provided for supporting the carriages on the channels for movement therealong and, in the embodiment shown, vertically spaced flanges 33*a* and 33*b* are provided on the side walls and guides such as wheels 34 are provided on the carriage and adapted to ride between the flanges 33*a* and 33*b*. Any suitable gearing 17 may be utilized to connect the operating shaft 15 with the slat carriers 11 on the carriages to turn the latter in response to rotation of the operating shaft 15. In the embodiment illustrated in FIG. 7, the gearing is of the rack and pinion type disclosed in U.S. Pat. Nos. 3,280,891 and 4,122,884, to which reference is hereby made for a more complete disclosure. In general, the rack and pinion gear includes a rack member 35 having a first set of rack teeth 35*a* on its upper side engageable with the externally splined shaft 15 to be reciprocated thereby in a direction crosswise of the channel in response to rotation of the operating shaft, and a second set of rack teeth 35*b* on a side face engageable with a pinion gear 36 on the upper end of the slat carrier 11 to rotate the latter about an upright axis in response to reciprocation of the rack member crosswise of the channel. Provision is also advantageously made for controlling the spacing between the carriages when the blind is in its closed position. In the embodiment illustrated, the carriage spacing means is in the form of a pantograph or lazy tongs linkage 38, of the type more fully disclosed in the aforementioned U.S. Pat. No. 3,280,891, it being understood that the spacing of the carriages could also be controlled by other means such as spacer links as disclosed in the aforementioned U.S. Pat. No. 4,122,884.

In accordance with the present invention, the speed reducing drive mechanism 21 for the operating shaft 15 utilizes a planetary gear assembly that is mounted within the end of the channel and in-line with the blind operating shaft 15. The drive mechanism includes a stationary housing 41 dimensioned to be received entirely within an end of the channel 12 and arranged to enclose the gear mechanism. The gear mechanism includes an annular internal ring gear 42 fixed to the housing 41; a planet carrier 43 mounted for rotation on the housing about the axis of the ring gear; a drive wheel 44 mounted on the housing for rotation about the axis of the ring gear; a sun gear 45 extending axially into the ring gear, and at least one and preferably several planetary gears 46 in meshing engagement with the sun and ring gears and mounted on the planet carrier for rotation about axes parallel to the axis of the ring gear and spaced radially inwardly from the ring gear. The drive wheel 44 has a drive sprocket 47 disposed coaxial with the ring gear and an endless flexible chain 48 is entrained over the drive sprocket and has downwardly extending runs 48*a* adapted to be drawn or pulled to rotate the drive sprocket in one direction or the other. The planet carrier 43 has an axially extending hub 49 which is non-rotatably connected to the blind operating shaft 15. With the construction shown, rotation of the drive sprocket will effect rotation of the hub 49 and shaft 15 in the same direction as the drive sprocket, but at a relatively reduced speed, for example a speed reduction of about six to one.

Figure 1:
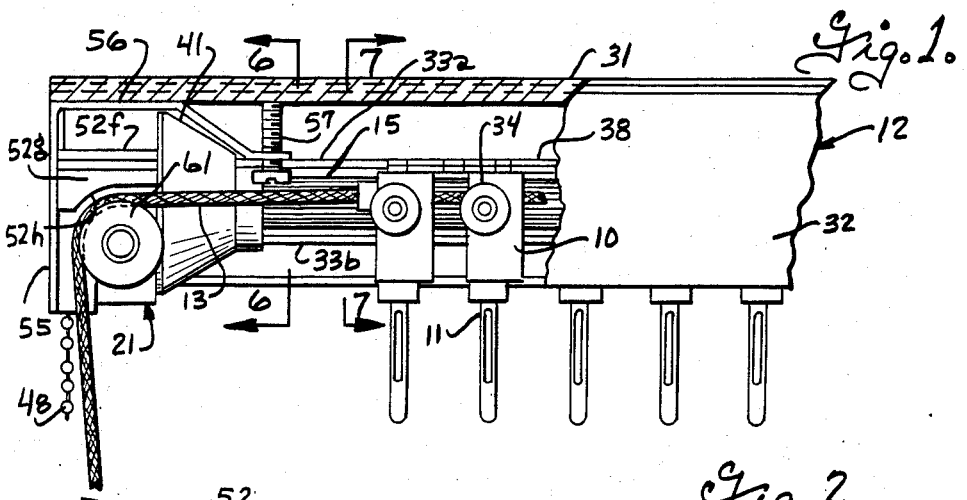
FIG. 1 is a fragmentary front elevational view of a vertical venetian blind apparatus, with parts of the carriage guide channel broken away to illustrate the blind operating mechanism of the present invention.
Figure 2:
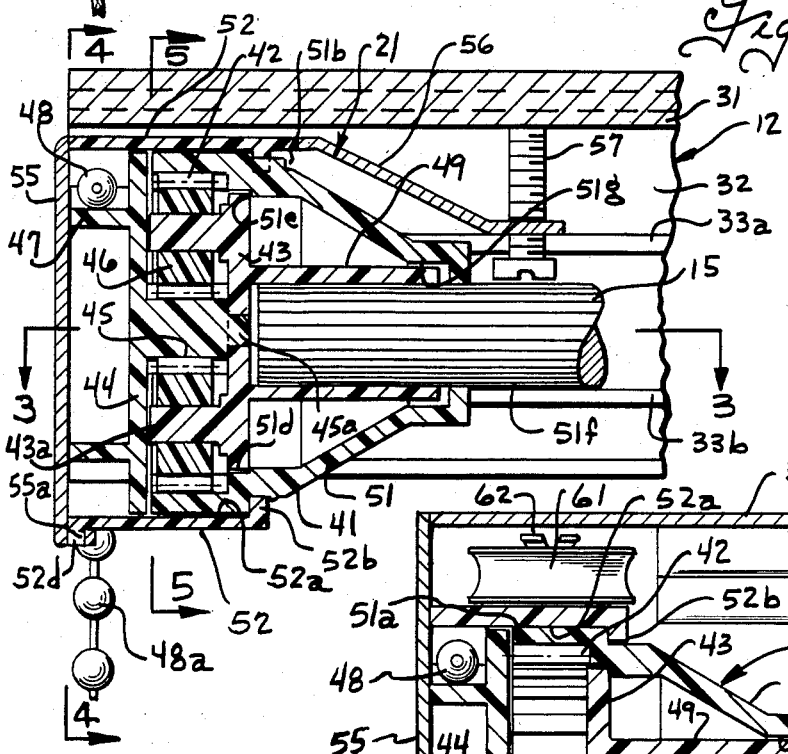
FIG. 2 is a fragmentary vertical longitudinal sectional view through the carriage guide channel and a drive mechanism showing the parts on a larger scale than FIG. 1.
Figure 3:
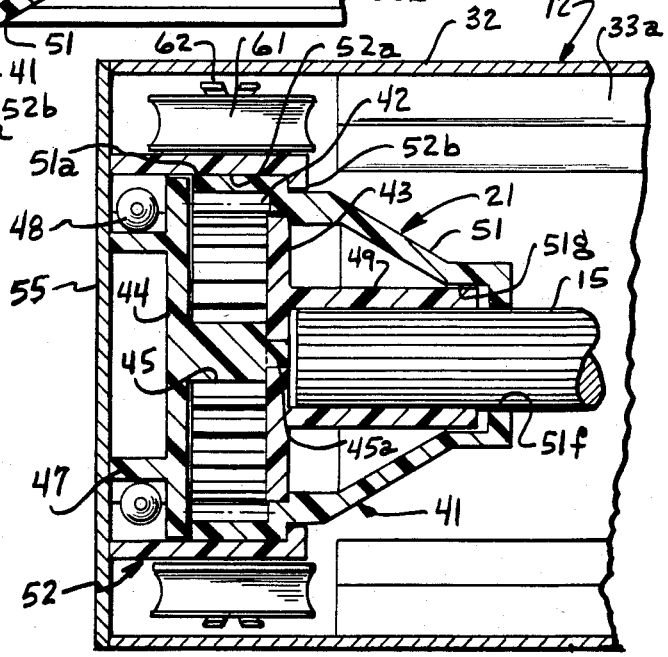
FIG. 3 is a fragmentary horizontal longitudinal sectional view taken on the plane 3—3 of FIG. 2.
Figure 5:
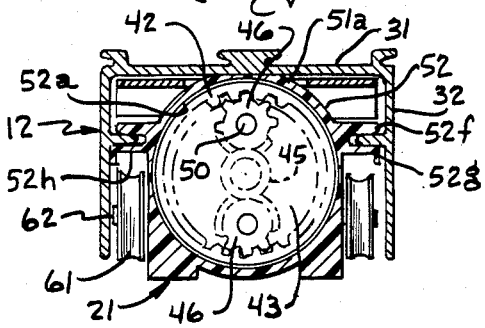
FIG. 5 is a transverse vertical sectional view taken on the plane 5—5 of FIG. 2.
Figure 6:
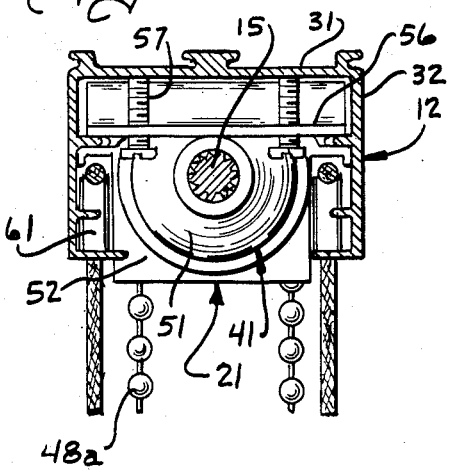
FIG. 6 is a transverse vertical sectional view taken on the plane 6—6 of FIG. 1.

The speed reducing drive mechanism is advantageously arranged so that almost all of the parts can be economically formed by molding and easily assembled. The parts are preferably formed of a moldable synthetic resin material and may, for example, be formed of a plastic material having good dimensional stability and low coefficient of friction such as an acetal homopolymer. The housing is advantageously molded in two axially interfitting sections 51 and 52. The housing section 52 has a generally cylindrical inner wall portion 52*a* and a flange 52*b* at one end and the housing section 51 has a generally cylindrical outer wall portion 51*a* that is received in the housing section 52 and which abuts against the flange 52*b*, as best shown in FIGS. 2, 3 and 5. The housing sections are non-rotatably interconnected and may, for example, be joined by sonic welding, adhesive bonding or the like. In addition, a key means including a rib 51*b* (FIG. 2) is provided on the housing section 51 and arranged to extend into the notch in the flange 52*b*, to positively lock the housing section 51 against turning relative to the housing section 52.

The teeth of the ring gear 42 are advantageously molded integrally with the housing section 51. The planet carrier is rotatably supported on the housing and, as best shown in FIGS. 2 and 3, comprises a generally disk shaped body having a circular outer periphery that is rotatably supported by a generally circular inner wall portion 51*d* on the housing section 51 at one end of the ring gear 42. The outer diameter of the planet carrier and the diameter of the wall portion 51*d* is made sufficiently smaller than the inner diameter of the ring gear to allow insertion of the planet carrier into the housing from one end, and a shoulder 51*e* is provided in the housing to engage the carrier to axially position the planet carrier. The housing is also advantageously arranged to radially support the shaft 15, to limit radial loading on the planetary gear mechanism. As will be seen from FIGS. 2 and 3, the housing section 51 surrounds and extends beyond the end of the hub 49 on the planet carrier and has a generally circular internal wall portion 51*f* that extends around and which is dimensioned to rotatably support the shaft 15. The housing is also preferably formed with an inner wall portion 51*g* that surrounds at least a portion of the hub 49 and has a clearance which is slightly greater than the clearance between the wall portion 51*f* and the shaft, and which is yet sufficiently small to prevent excessive radial shifting of the hub on the planet carrier.

The drive wheel 44 has a generally circular periphery dimensioned to be rotatably received in and supported on the wall portion 52*a* of the housing section 52, at the outer end of the ring gear 42. The sun gear 45 is conveniently molded integrally with the drive wheel 44 and extends from one side of the drive wheel coaxially of the ring gear. The end of the sun gear engages the planet carrier 43 to control the axial spacing between the drive wheel and the planet carrier and a pintle 45*a* is molded on the end of the sun gear 45 and extends into an axial opening 47 in the planet carrier to radially support the inner end of the sun gear on the planet carrier. The planet gears 46 are rotatably supported on pintles 43*a* which are preferably molded integrally with the planet carrier and extend from the side of the planet carrier opposite the hub 49.

Figure 4:
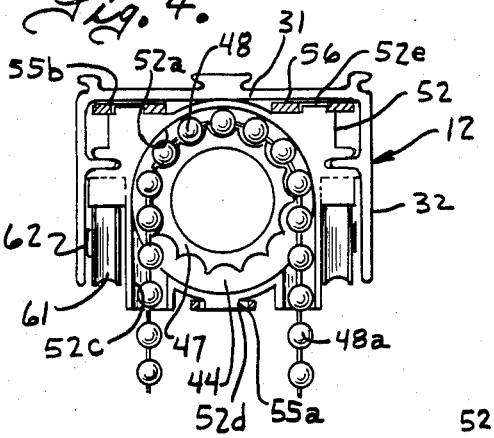
FIG. 4 is transverse vertical sectional view taken on the plane 4—4 of FIG. 2.

The housing section 52 extends axially beyond the drive wheel 44 and the inner wall portion 52*a* extends around at least a major portion of the periphery of the sprocket to retain the upper loop of the drive chain on the sprocket as shown in FIG. 4. The outer housing section 52 is also formed with chain guide passages 52*c* that extend downwardly and generally tangent to the wall portion 52*a* to allow passage of the downwardly extending runs 48*a* of the drive chain. A plate 55 overlies the end of the housing to retain the drive sprocket and drive chain in position and to also provide a closure for the end of the support channel 10. The plate 55 forms part of a generally L-shaped bracket and the plate 55 is retained in position on the end of the housing by lower and upper lugs 52*d* and 52*e* respectively on the outer housing section and which are arranged to extend into sockets 55*a* and 55*b* provided adjacent the lower and upper ends of the plate 55. The lower socket 55*a* is conveniently formed by offsetting a portion of the lower edge of the plate as shown in FIG. 2, and the upper sockets 55*b* conveniently comprise openings formed in a laterally extending plate 56 on the upper end of the plate 55.

The housing section 52 is shaped to engage the channel to support the housing on the channel and, as best shown in FIGS. 4 and 5, the housing section 52 is formed with lugs 52*f* and 52*g* which are arranged to engage relatively opposite sides of one of the flanges 33*a* on the channel. The plate 56 extends forwardly from the upper edge of plate 55 and, as best shown in FIGS. 2, 4 and 5, has a central opening which receives the top of the housing section 52. Screw fasteners 57 are threadedly mounted therein and arranged to engage the underside of the top wall 31 of the channel when the screws are tightened to clamp the forward end of the plate 56 against the flange 33*a* and lock the housing aganst movement in a direction lengthwise of the channel 10.

Cord guide pulleys 61 are provided for guiding the traverse cords from the horizontal run in the channels to the downwardly extending runs. In order to minimize the dead space at the end of the blind, the cord guide pulleys are located closely adjacent the outer end of the housing and such that the downwardly extending runs of the traverse cords are disposed closely adjacent the plane through the end of the housing. The cord guide pulleys are conveniently supported on pintles 62 formed integrally with the outer housing section 52 and the cord guide pulleys may be of the anti-friction type if desired. The undersurface of one of the support lugs 52*g* is preferably contoured as shown at 52*h* to closely overlie the traverse cord as it passes around the pulley to retain the cord on the pulley.

From the foregoing it is believed that the construction and operation of the traverse cord with in-line speed reducing mechanism, will be readily understood. The sections of the housing and the gear mechanism can be economically molded of synthetic resin material and the gear mechanism is arranged so that it can be readily assembled into the housing from one end. The planet carrier and drive wheel are rotatably supported at their peripheries on the housing and, when the plate 55 is positioned over the end of the housing, the several rotating parts of the gear mechanism are constrained against axial movement between the plate and the shoulder 52*e* on the housing. The housing is also preferably arranged to provide direct radial support for the shaft and to minimize transmission of radial loads on the shaft to the gear mechanism. The planetary gear mechanism drives the operating shaft at a uniform rate in response to rotation of the input shaft, but at a relatively high speed reduction which in the embodiment shown is about six to one.

The embodiments of the invention in which an exclusive property or privilege is claimed are defined as follows:

1. In a vertical venetian blind closure of the type including a horizontal carriage guide channel having an opening along one side, a shaft extending lengthwise of the channel, a plurality of carriages mounted on the guide channel for movement therealong, a slat carrier mounted on each of the carriages for rotation about an upright axis, gear means in each of said carriages engageable with said shaft and with the respective slat carrier for rotating the latter in response to rotation of the shaft, and a shaft turning mechanism at one end of the shaft for turning the same, the improvement comprising, said shaft turning mechanism including a stationary housing means disposed substantially entirely within said channel with one end of the housing means adjacent one end of the channel, said housing means having a stepped passage therethrough opening at opposite ends of the housing means, the stepped passage having an annular internal ring gear intermediate its ends; a first generally circular inner wall portion at one end of the internal ring gear and having a larger internal diameter than the internal ring gear, and a second generally circular internal wall portion at the other end of the internal ring gear and having a smaller internal diameter than the internal ring gear, a planet carrier means having an annular peripheral portion rotatably supported on said second annular internal wall portion for rotation about the axis of the ring gear, means non-rotatably connecting the planet carrier means to said shaft, drive wheel means having an annular peripheral portion rotatably supported on said first annular internal wall portion for rotation about the axis of the ring gear and having a sun gear at one side thereof extending into the ring gear concentrically of the latter and a drive sprocket at the other side thereof coaxial with the sun gear, at least one planet gear in meshing engagement with the sun and ring gears and mounted on the planet carrier means for rotation relative thereto about an axis parallel to the axis of the ring gear and spaced radially inwardly therefrom to rotate the planet carrier means in response to rotation of the drive wheel means but at a relatively reduced speed, and a flexible drive chain entrained over the sprocket for rotating the drive wheel means.

2. The combination of claim 1 wherein said stepped passage in said housing includes a third generally circular internal wall portion surrounding said shaft adjacent the distal end of said hub for radially supporting said one end of said shaft.

3. The combination of claim 1 wherein said means non-rotatably connecting the planet carrier to said shaft includes a hub on said planet carrier means, said stepped passage in said housing including a third generally circular internal wall portion surrounding said shaft adjacent the distal end of said hub for radially supporting said one end of said shaft, and said stepped passage including a fourth generally circular internal wall portion surrounding a portion of said hub.

4. The combination of claim 1 wherein the end of said sun gear remote from the drive wheel engages said planet carrier means to control the axial spacing therebetween and has means thereon for radially supporting the end of sun gear on the planet carrier means.

5. The combination of claim 1 including a plate overlying said one end of said housing and the end of said drive sprocket.

6. The combination of claim 1 wherein said housing has an internal wall portion extending from said first generally circular wall portion to said one end of said housing and extending around the drive sprocket at the top and sides of the channel to retain the flexible chain on the drive sprocket.

7. The combination of claim 6 including a plate overlying said one end of said housing and the end of the drive sprocket.

8. The combination of claim 1 wherein the ring gear is formed integrally with said housing means.

9. The combination of claim 1 wherein the planet carrier means includes a disk having a peripheral portion rotatably supported on said second annular internal wall portion and a hub formed integrally with said disk at one side thereof for connection to said shaft and at least one pintle formed integrally with the disk and extending from the other side thereof for rotatably supporting the planet gear.

10. The combination of claim 9 wherein the sun gear and drive sprocket are formed integrally with said drive wheel means.

11. The combination of claim 7 including traverse cord means for moving the carriages along the channel, and traverse cord guide rollers mounted on the housing means at relatively opposite sides thereof closely adjacent said one end of the housing means to guide the traverse cord means from the channel in a plane closely adjacent said one end of the housing means.

* * * * *